US012442267B1

(12) United States Patent
Pettibone et al.

(10) Patent No.: US 12,442,267 B1
(45) Date of Patent: Oct. 14, 2025

(54) CONTROL SYSTEMS AND METHODS FOR RCD ACTIVE PRESSURE COMPENSATION

(71) Applicant: Schlumberger Technology Corporation, Sugar Land, TX (US)

(72) Inventors: Nathaniel Pettibone, Houston, TX (US); Kody Carrillo, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/787,266

(22) Filed: Jul. 29, 2024

(51) Int. Cl.
*E21B 33/08* (2006.01)
*E21B 47/06* (2012.01)

(52) U.S. Cl.
CPC ..... *E21B 33/085* (2013.01); *E21B 47/06* (2013.01)

(58) Field of Classification Search
CPC ..... E21B 33/085; E21B 47/06
See application file for complete search history.

(56) References Cited

U.S. PATENT DOCUMENTS 5,178,215 A * 1/1993 Yenulis ..... E21B 33/085 251/1.1
6,227,547 B1 5/2001 Dietle
7,040,394 B2 5/2006 Bailey
7,258,171 B2 8/2007 Bourgoyne
8,096,711 B2 1/2012 Beauchamp et al.
8,347,982 B2 * 1/2013 Hannegan ..... E21B 33/085 166/347
8,500,337 B2 8/2013 Beauchamp
9,284,811 B2 3/2016 Michaud
9,567,817 B2 2/2017 Chambers
9,702,210 B2 7/2017 Dirksen
10,087,701 B2 10/2018 Bailey
10,240,426 B2 3/2019 Grace
10,267,117 B2 4/2019 Bailey
11,149,507 B2 10/2021 Tran
11,187,056 B1 11/2021 Tenorio
11,236,575 B2 2/2022 Dietrich
2011/0024195 A1 * 2/2011 Hoyer ..... E21B 21/10 166/386
2016/0168911 A1 6/2016 Karigan
2019/0093445 A1 3/2019 Kulkarni
2019/0234173 A1 8/2019 Bennett

* cited by examiner

*Primary Examiner* — Brad Harcourt
(74) *Attorney, Agent, or Firm* — Jeffrey D. Frantz

(57) ABSTRACT

Control systems and methods for rotating control device (RCD) active pressure compensation are provided. A control system for an RCD for rotary drilling in a wellbore includes: RCD equipment having an internal pressure $P_3$, wellbore having a wellbore pressure $P_1$, the RCD equipment being operably connected to the wellbore, a return line leading toward a ground surface and having a return pressure $P_2$, the RCD equipment being operably connected to the return line, and a regulator configured to adjust a fluid pressure supplied to the RCD to control the internal pressure $P_3$.

5 Claims, 7 Drawing Sheets

CONTROL SYSTEMS AND METHODS FOR RCD ACTIVE PRESSURE COMPENSATION

TECHNICAL FIELD

This disclosure generally relates to control systems and methods for rotating control device (RCD) active pressure compensation.

BACKGROUND

A rotating control device (RCD) is used to contain and isolate pressure in a wellbore annulus during rotary drilling. The RCD includes a sealing element and a bearing assembly. The outside of the assembly is sealed, while the inside rotates with the pipe. The sealing element creates a seal against a drill string (e.g., pipe) while drilling. The bearing assembly allows the sealing element to rotate with the drill string, eliminating any relative rotation between the drill string and the sealing element.

To operate reliably and without failure, the bearings in the RCD must be kept clean and protected from the abrasive particles and corrosive environment found in the wellbore. This is done by some arrangement of rotary seals, which isolate the fluid and pressure of the wellbore from the bearings. Rotary seals are typically limited in their ability to seal high pressure differentials while also rotating at high speed. In other words, there is a tradeoff between the rotational speed and the pressure. In higher pressure managed-pressure drilling (MPD) operations, this means that the rotary seals commonly fail to provide adequate sealing, allowing wellbore fluid into the bearing chamber of the RCD.

Conventional pressurized lubrication systems can apply a lubricant internally to the RCD equipment, and thus may route pressurized fluid lubrication to the seals. U.S. Pat. No. 8,500,337 to Beauchamp et al. and U.S. Pat. No. 8,096,711 to Beauchamp et al. show conventional examples of pressurized fluid lubrication provided to the seals. However, the conventional art does not dynamically control the source or pressure of the fluid lubrication. Neither patent addresses the source of fluid nor how the supply pressure is controlled. As such, the conventional art also does not detail how external fluid is brought to the seals or any relation to dynamically-applied pressure to the RCD equipment, but only describes, at most, a mechanical design inside the equipment for physical communication of chambers between the seals to distribute statically-applied external pressure.

Accordingly, there is a need for the rotary seals to provide dynamic control of pressurized lubrication to the seals of RCD equipment for adequate sealing to prevent wellbore fluid from penetrating into the bearing chamber of the RCD.

BRIEF SUMMARY

This disclosure pertains to control systems and methods for rotating control device (RCD) active pressure compensation.

Rotary seals in an RCD require active compensation to reduce differential pressure for reliable performance. Bearings in an RCD require clean fluid and lubrication to prevent premature wear. An active pressure compensation system supplies the fluid for both.

An active pressure compensation control system according to an embodiment of the present disclosure provides a pressurized clean fluid supply to the bearing side of the rotary seals, reducing the pressure differential to be sealed, thus allowing the rotary seals to perform better. This control system can be configured in multiple ways to provide a variable or dynamic fluid supply pressure. The supply pressure can be controlled relative to other measured pressures or may be set independently. Control systems according to embodiments of the present disclosure may allow set points to be independent of other measurements or may be proportional to one or multiple other measurements. Control systems according to embodiments of the present disclosure may also allow for a logic-controlled ratio for the set pressure, or for a mechanical ratio set point.

A first aspect of this disclosure pertains to a control system for a rotating control device (RCD) for rotary drilling in a wellbore, including: RCD equipment having an internal pressure $P_3$, wellbore having a wellbore pressure $P_1$, the RCD equipment being operably connected to the wellbore, a return line leading toward a ground surface and having a return pressure $P_2$, the RCD equipment being operably connected to the return line, and a regulator configured to adjust a fluid pressure supplied to the RCD to control the internal pressure $P_3$.

A second aspect of this disclosure pertains to the system of the first aspect, wherein the regulator includes a manual pressure regulator.

A third aspect of this disclosure pertains to the system of the first aspect, and further includes a wellbore pressure gauge operably connected to the wellbore and configured to read the wellbore pressure $P_1$ at the wellbore below the RCD.

A fourth aspect of this disclosure pertains to the system of the third aspect, and further includes: a software logic configured to automatically control the wellbore pressure gauge and the regulator, wherein the regulator is further configured to control the internal pressure $P_3$ based on the wellbore pressure $P_1$ read by the wellbore pressure gauge.

A fifth aspect of this disclosure pertains to the system of the fourth aspect, and further includes: a return pressure gauge operably connected to the return line and configured to read the return pressure $P_2$ at the return line above the RCD, wherein the software logic is further configured to automatically control the return pressure gauge, and wherein the regulator is further configured to control the internal pressure $P_3$ based on the wellbore pressure $P_1$ read by the wellbore pressure gauge and the return pressure $P_2$ read by the return pressure gauge.

A sixth aspect of this disclosure pertains to the system of the fifth aspect, wherein the regulator is further configured to control the internal pressure $P_3$ according to:

$$P_3 \propto \frac{P_1}{P_2}.$$

A seventh aspect of this disclosure pertains to the system of the first aspect, wherein the regulator is further configured to: receive information corresponding to the wellbore pressure $P_1$, and control the internal pressure $P_3$ based on the wellbore pressure $P_1$.

An eighth aspect of this disclosure pertains to the system of the seventh aspect, wherein the regulator is further configured to control the internal pressure $P_3$ according to: $P_3 \propto P_1$, where $P_3 < P_1$.

A ninth aspect of this disclosure pertains to the system of the first aspect, and further includes a hydraulic logic circuit configured to: receive information corresponding to the wellbore pressure $P_1$, and automatically control the regulator to control the internal pressure $P_3$ based on the wellbore pressure $P_1$.

A tenth aspect of this disclosure pertains to the system of the ninth aspect, wherein the hydraulic logic circuit is further configured to control the regulator to control the internal pressure $P_3$ according to:

$$P_3 \propto \frac{P_1}{P_2}.$$

An eleventh aspect of this disclosure pertains to the system of the first aspect, and further includes: a reservoir configured to contain a fluid to be supplied to an input port of the RCD at the internal pressure $P_3$, and a pump operatively connected between the reservoir and the regulator, the pump being configured to supply the fluid from the reservoir to the regulator.

A twelfth aspect of this disclosure pertains to a method for a control system for a rotating control device (RCD) for rotary drilling in a wellbore, the method including: providing RCD equipment with an internal pressure $P_3$, providing a wellbore with a wellbore pressure $P_1$, the RCD equipment being operably connected to the wellbore, providing a return line leading toward a ground surface, the return line having a return pressure $P_2$, the RCD equipment being operably connected to the return line, and adjusting, by a regulator, a fluid pressure supplied to the RCD to control the internal pressure $P_3$.

A thirteenth aspect of this disclosure pertains to the method of the twelfth aspect, and further includes reading the wellbore pressure $P_1$ at the wellbore below the RCD by a wellbore pressure gauge operably connected to the wellbore.

A fourteenth aspect of this disclosure pertains to the method of the thirteenth aspect, and further includes: automatically controlling the wellbore pressure gauge and the regulator using a software logic, and controlling the internal pressure $P_3$ by the regulator based on the wellbore pressure $P_1$ read by the wellbore pressure gauge.

A fifteenth aspect of this disclosure pertains to the method of the fourteenth aspect, and further includes: reading the return pressure $P_2$ at the return line above the RCD by a return pressure gauge operably connected to the return line, automatically controlling the return pressure gauge using the software logic, and controlling the internal pressure $P_3$ by the regulator based on the wellbore pressure $P_1$ read by the wellbore pressure gauge and the return pressure $P_2$ read by the return pressure gauge.

A sixteenth aspect of this disclosure pertains to the method of the fifteenth aspect, and further includes controlling the internal pressure $P_3$, using the regulator, according to:

$$P_3 \propto \frac{P_1}{P_2}.$$

A seventeenth aspect of this disclosure pertains to the method of the twelfth aspect, and further includes using the regulator to: receive information corresponding to the wellbore pressure $P_1$, and control the internal pressure $P_3$ based on the wellbore pressure $P_1$.

An eighteenth aspect of this disclosure pertains to the method of the seventeenth aspect, and further includes controlling the internal pressure $P_3$, using the regulator, according to: $P_3 \propto P_1$, where $P_3 < P_1$.

A nineteenth aspect of this disclosure pertains to the method of the twelfth aspect, and further includes using a hydraulic logic circuit to: receive information corresponding to the wellbore pressure $P_1$, and automatically control the regulator to control the internal pressure $P_3$ based on the wellbore pressure $P_1$.

A twentieth aspect of this disclosure pertains to the method of the nineteenth aspect, and further includes controlling the regulator, using the hydraulic logic circuit, to control the internal pressure $P_3$ according to:

$$P_3 \propto \frac{P_1}{P_2}.$$

A twenty-first aspect of this disclosure pertains to the method of the twelfth aspect, and further includes: supplying a fluid, from a reservoir containing the fluid, to an input port of the RCD at the internal pressure $P_3$, and supplying the fluid from the reservoir to the regulator using a pump operatively connected between the reservoir and the regulator.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF DRAWINGS

To describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which.

Figure 1:
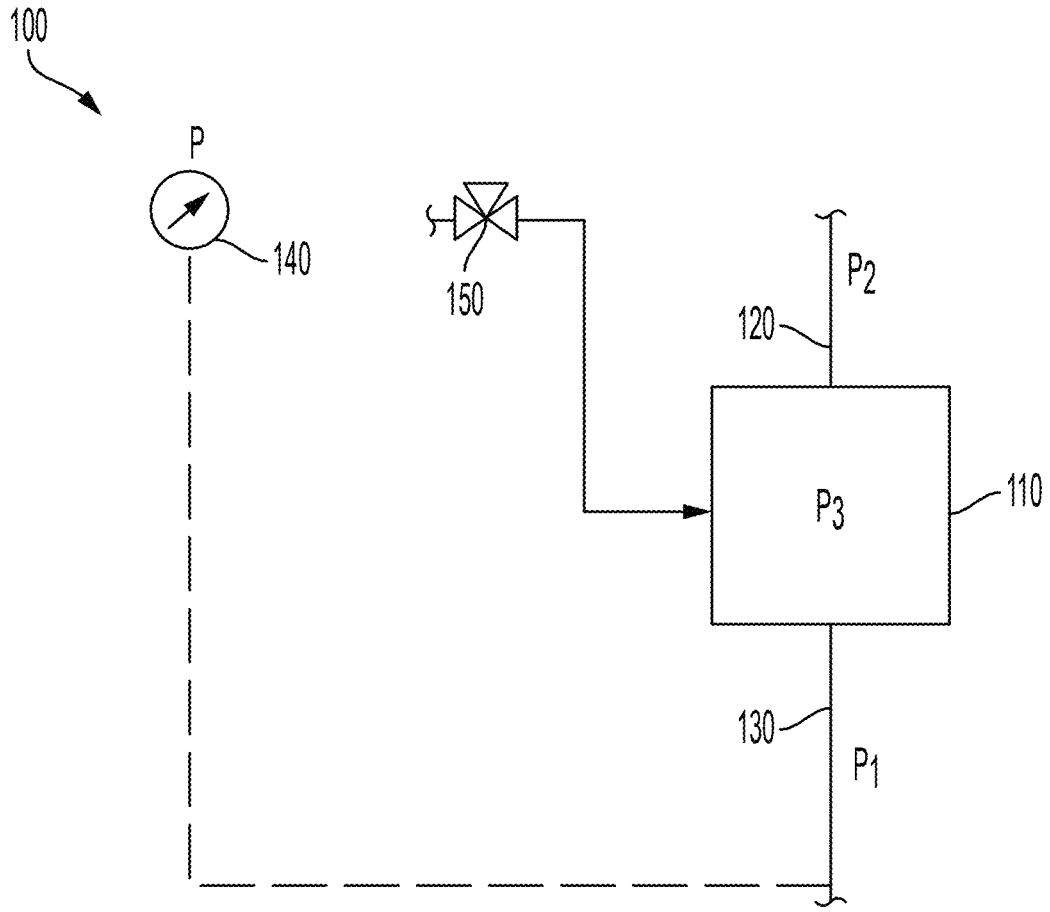
FIG. 1 is a control system for a rotating control device (RCD) in accordance with an example embodiment of the present disclosure.

Before explaining the disclosed embodiment of this disclosure in detail, it is to be understood that the invention is not limited in its application to the details of the particular arrangement shown, as the invention is capable of other embodiments. Example embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

While the subject disclosure applies to embodiments in many different forms, there are shown in the drawings and will be described in detail herein specific embodiments with the understanding that the present disclosure is an example of the principles of the invention. It is not intended to limit the invention to the specific illustrated embodiments. The features of the invention disclosed herein in the description, drawings, and claims can be significant, both individually and in any desired combinations, for the operation of the invention in its various embodiments. Features from one embodiment can be used in other embodiments of the invention. In the description of the drawings, like reference numerals refer to like elements.

As mentioned above, a pressurized fluid can be used to assist the performance of the rotary seals in a rotating control device (RCD). The routing and configuration of the fluid inside the RCD can vary depending on specifications of the particular equipment being used. The focus of the present disclosure is a control system that supplies the pressurized fluid to the RCD itself. The control system can take various forms. In one example, an integrated box may mount directly on the side of the RCD to a distributed series of components and tubing, which may be placed elsewhere in a managed-pressure drilling (MPD) system.

FIGS. 1-6 are control systems for a rotating control device (RCD) in accordance with example embodiments of the present disclosure.

The configurations in the drawings are simplified generalizations of RCD control systems according to example embodiments. In all examples, $P_1$ is the wellbore pressure before the RCD, $P_2$ is a riser/atmosphere pressure above the RCD, and $P_3$ is the internal pressure of the RCD supplied by the control system.

FIG. 1 shows an RCD control system 100 according to an example embodiment that includes a basic setup for controlling RCD equipment 110. The RCD equipment 110 is connected to a return line 120 leading to the surface and a wellbore 130. The wellbore 130 may be at a wellbore pressure $P_1$. The return line 120 may be at a riser/atmosphere return pressure $P_2$. The RCD equipment 110 may be at an internal pressure $P_3$. An independent pressure gauge 140 may read the wellbore pressure $P_1$ at the wellbore 130 below the RCD 110. Separately, a regulator (or valve) 150, which may be a manual pressure regulator, may be used to adjust the fluid pressure supplied to the RCD to provide the internal pressure $P_3$. The regulator 150 may be fed from a high-pressure fluid supply, the power source of which is not shown.

Figure 2:
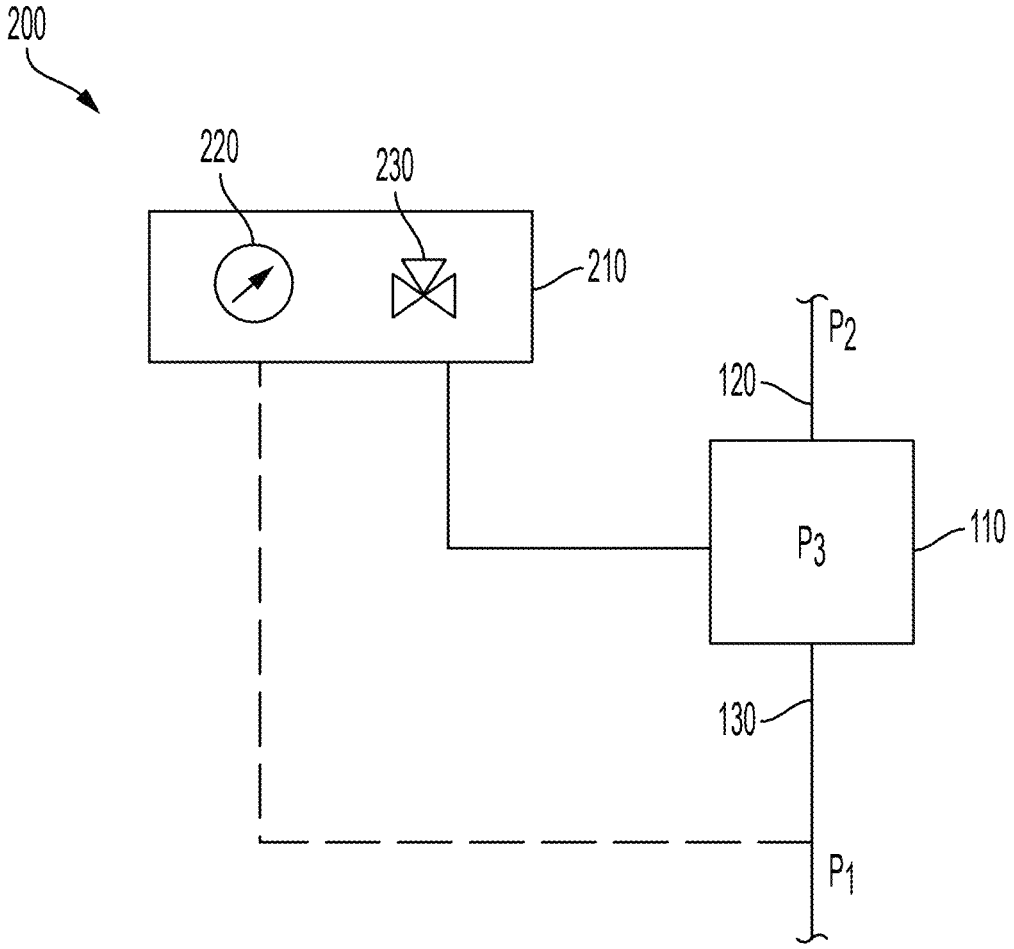
FIG. 2 is a control system for a rotating control device (RCD) in accordance with an example embodiment of the present disclosure.

FIG. 2 shows an RCD control system 200 according to an example embodiment that builds upon the FIG. 1 RCD control system 100 configuration by taking the reading of the wellbore pressure $P_1$ and using internal software logic 210 to automatically regulate the fluid pressure supplied. The internal software logic 210 may control a pressure gauge 220 to read the wellbore pressure $P_1$, and may control a regulator 230 to adjust the fluid pressure supplied to the RCD 110 to control the internal pressure $P_3$.

Figure 3:
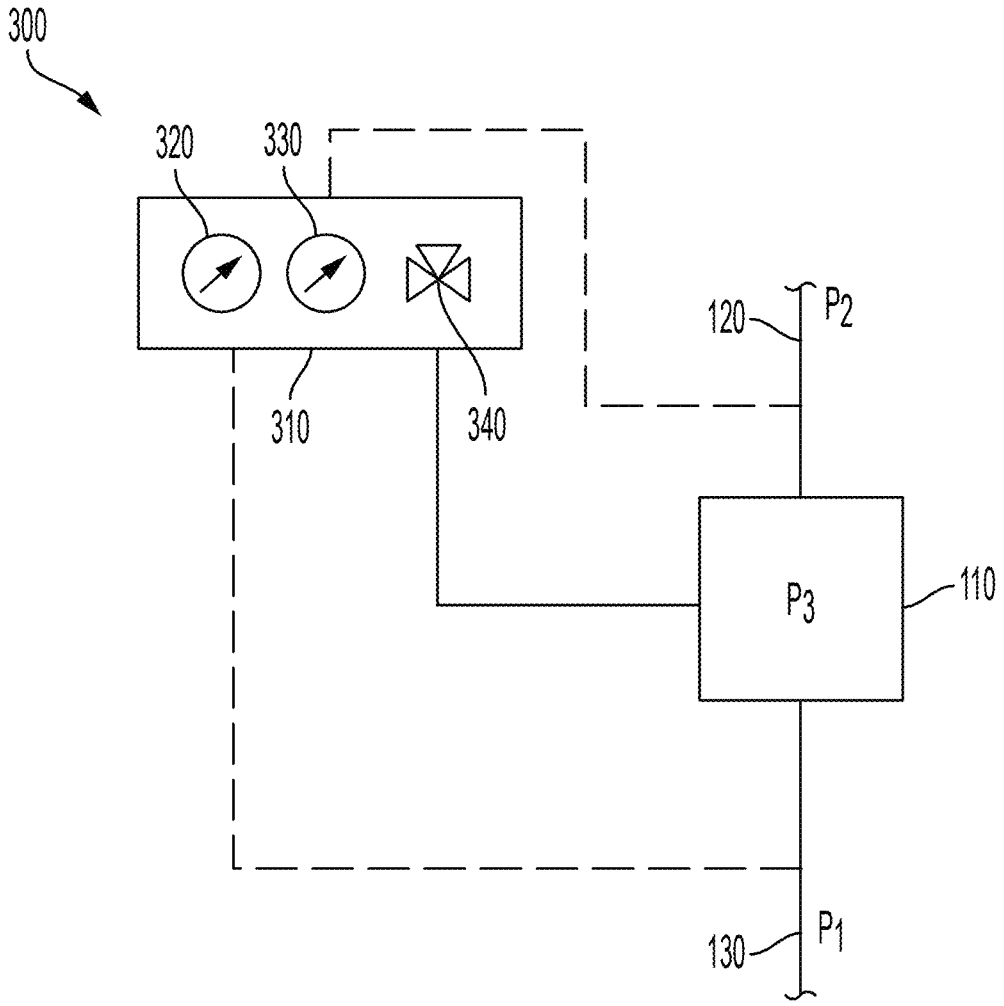
FIG. 3 is a control system for a rotating control device (RCD) in accordance with an example embodiment of the present disclosure.

FIG. 3 shows an RCD control system 300 according to an example embodiment that uses pressure readings from both the wellbore and the riser pressures $P_1$, $P_2$, uses some software logic 310, and automatically adjusts the regulated internal supply pressure $P_3$ to some ratio of $P_1$ and $P_2$ combined. In the FIG. 3 example, $$P_3 \propto \frac{P_1}{P_2}.$$

As such, the internal pressure $P_3$ may be proportional to a ratio of the wellbore pressure $P_1$ to the return pressure $P_2$. The wellbore pressure may be measured by a first pressure gauge 320, and the riser pressure may be measured by a second pressure gauge 330. The regulated internal supply pressure $P_3$ may be adjusted by a regulator 340. Both pressure gauges 320, 330 and the regulator 340 may be controlled by the software logic 310.

Figure 4:
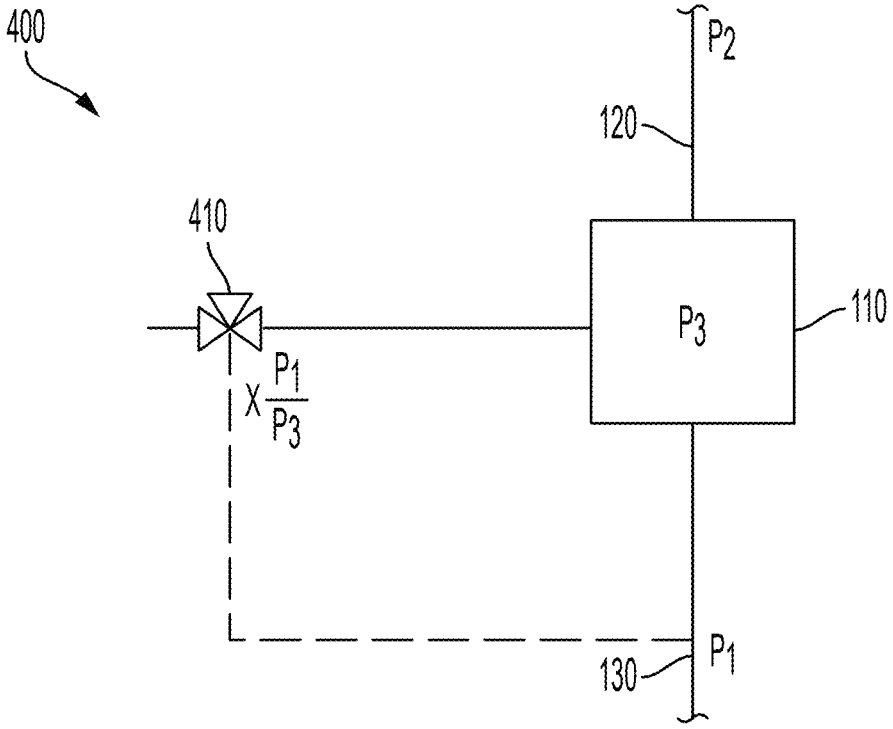
FIG. 4 is a control system for a rotating control device (RCD) in accordance with an example embodiment of the present disclosure.

FIG. 4 shows an RCD control system 400 according to an example embodiment that is similar to the FIG. 2 RCD control system 200 in that the supplied internal pressure $P_3$ may be regulated to some percentage of the wellbore pressure $P_1$, for example, $$X\left(\frac{P_1}{P_3}\right).$$

However, the automatic pressure adjustment of the FIG. 3 example may be performed mechanically with hydraulic components, e.g., the regulator 410. In other words, the regulator 410 may be controlled to automatically supply the internal pressure $P_3$ proportionally to the wellbore pressure $P_1$ as a pressure less than the wellbore pressure $P_1$.

Figure 5:
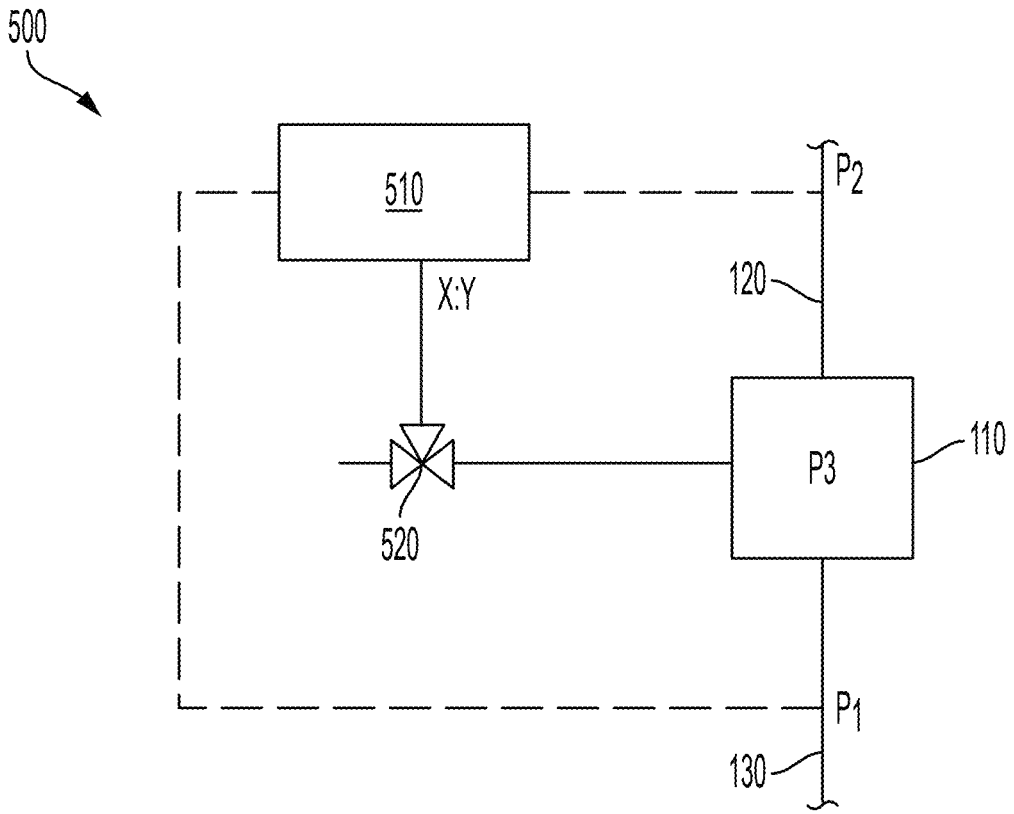
FIG. 5 is a control system for a rotating control device (RCD) in accordance with an example embodiment of the present disclosure.

FIG. 5 shows an RCD control system 500 according to an example embodiment that is similar to the FIG. 3 RCD control system 300 in that the supplied pressure may be automatically regulated to some ratio "X:Y" that combines $P_1$ and $P_2$, e.g., $$\frac{P_1}{P_2} \text{ or } X\left(\frac{P_1}{P_2}\right).$$

However, this automatic adjustment may be performed mechanically with a hydraulic logic circuit 510. The hydraulic logic circuit 510 may control a regulator 520 that may provide the internal pressure $P_3$ to the RCD 110.

Figure 6:
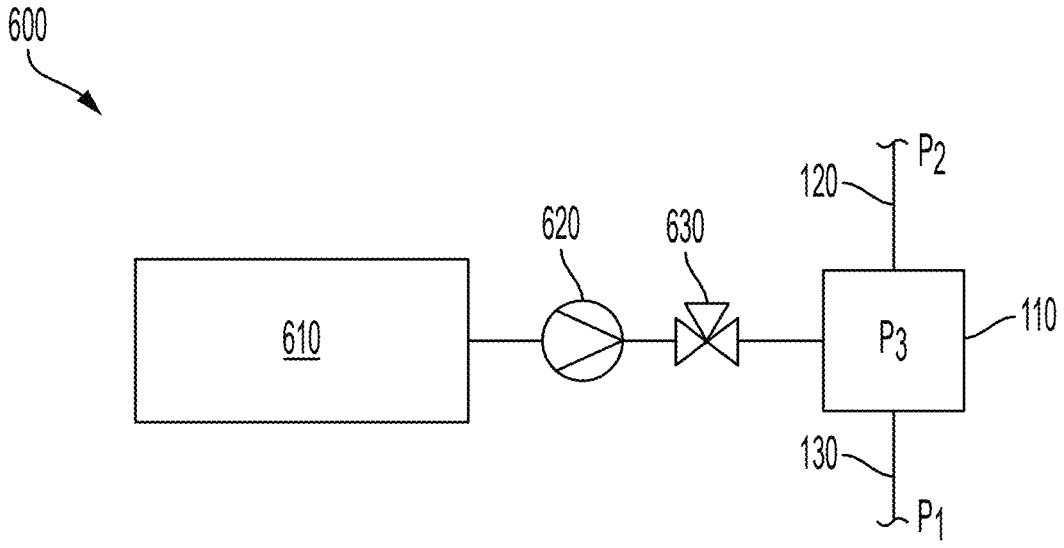
FIG. 6 is a control system for a rotating control device (RCD) in accordance with an example embodiment of the present disclosure.

FIG. 6 shows an RCD control system 600 according to an example embodiment that may include a standalone grease/ fluid reservoir 610 that may include its own pump 620 to create the internal supply pressure $P_3$. The pump 610 may provide fluid to a regulator 630, which may adjust the pressure of the liquid from the pump to be at the desired internal supply pressure $P_3$. The control system 600 may work independently of the hydraulic system of the rig, potentially simplifying the rig controls.

Figure 7:
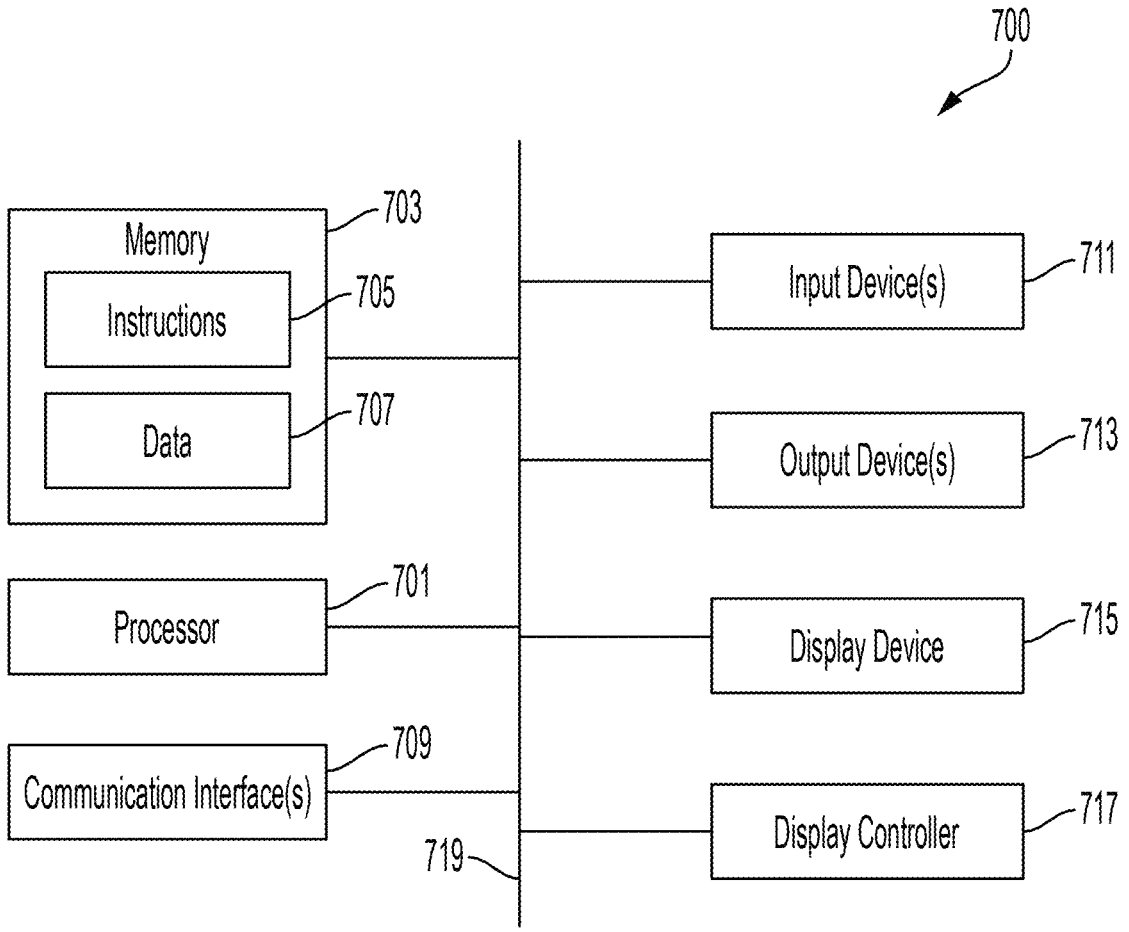
FIG. 7 illustrates certain components that may be included within a computer system according to an example embodiment of the present disclosure.

FIG. 7 illustrates certain components that may be included within a computer system according to an example embodiment of the present disclosure.

FIG. 7 illustrates certain components that may be included within a computer system 700, which may be used to perform the operations of FIG. 1 and/or display FIGS. 2-3. One or more computer systems 700 may be used to implement the various devices, components, and systems described herein.

The computer system 700 includes a processor 701. The processor 701 may be a general-purpose single- or multi-chip microprocessor (e.g., an Advanced RISC (Reduced Instruction Set Computer) Machine (ARM)), a special-purpose microprocessor (e.g., a digital signal processor (DSP)), a microcontroller, a programmable gate array, etc. The processor 701 may be referred to as a central processing unit (CPU). Although just a single processor 701 is shown in the computer system 700 of FIG. 7, in an alternative configuration, a combination of processors (e.g., an ARM and DSP) could be used. In one or more embodiments, the computer system 700 further includes one or more graphics processing units (GPUs), which can provide processing services related to both entity classification and graph generation.

The computer system 700 also includes memory 703 in electronic communication with the processor 701. The memory 703 may be any electronic component capable of storing electronic information. For example, the memory 703 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions 705 and data 707 may be stored in the memory 703. The instructions 705 may be executable by the processor 701 to implement some or all of the functionality disclosed herein. Executing the instructions 705 may involve the use of the data 707 that is stored in the memory 703. Any of the various examples of modules and components described herein may be implemented, partially or wholly, as instructions 705 stored in memory 703 and executed by the processor 701. Any of the various examples of data described herein may be among the data 707 that is stored in memory 703 and used during execution of the instructions 705 by the processor 701.

A computer system 700 may also include one or more communication interfaces 709 for communicating with other electronic devices. The communication interface(s) 709 may be based on wired communication technology, wireless communication technology, or both. Some examples of communication interfaces 709 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system 700 may also include one or more input devices 711 and one or more output devices 713. Some examples of input devices 711 include a keyboard, mouse, microphone, remote control device, button, joystick, trackball, touchpad, and lightpen. Some examples of output devices 713 include a speaker and a printer. One specific type of output device that is typically included in a computer system 700 is a display device 715. Display devices 715 used with embodiments disclosed herein may utilize any suitable image projection technology, such as liquid crystal display (LCD), light-emitting diode (LED), gas plasma, electroluminescence, or the like. A display controller 717 may also be provided, for converting data 707 stored in the memory 703 into text, graphics, and/or moving images (as appropriate) shown on the display device 715.

The various components of the computer system 700 may be coupled together by one or more buses, which may include a power bus, a control signal bus, a status signal bus, a data bus, etc. For the sake of clarity, the various buses are illustrated in FIG. 7 as a bus system 719.

The control system for RCD active pressure compensation according to example embodiments may offer several benefits that enhance the functionality and reliability of managed pressure drilling (MPD) operations. Some example advantages of embodiments include:

Improved Seal Performance: By actively compensating for pressure differentials, the system reduces the burden on rotary seals, enhancing their performance and extending their service life.

Enhanced Bearing Longevity: The supply of clean, regulated hydraulic pressure to the bearing chamber may help maintain the integrity and reliability of the bearings, which are critical components in the RCD.

Increased Operational Efficiency: The control system may allow for smoother and more efficient drilling operations by preventing seal failures and associated downtime.

Versatility in Configuration: The system can be configured in various ways, including manual, software logic, or mechanical logic-based regulation, offering flexibility to meet different operational needs.

Compatibility with High-Pressure Operations: The system may be particularly beneficial in high-pressure MPD operations, where traditional rotary seals may fail due to inadequate sealing.

Cost Savings: By reducing the frequency of seal and bearing replacements, the control system can lead to significant cost savings over the life of the drilling equipment.

Market Impact: The introduction of this control system could improve customer perception of MPD products, potentially opening new markets and increasing sales.

Technological Innovation: The control system represents a step forward in drilling technology, showcasing the potential for innovation in the industry.

These example benefits of embodiments of the present disclosure collectively contribute to a more reliable, efficient, and cost-effective MPD operation, addressing some of the common challenges faced in drilling environments with high-pressure differentials.

Following are sections in accordance with at least one embodiment of the present disclosure:

Clause 1: A control system for a rotating control device (RCD) for rotary drilling in a wellbore, including: RCD equipment having an internal pressure $P_3$, wellbore having a wellbore pressure $P_1$, the RCD equipment being operably connected to the wellbore, a return line leading toward a ground surface and having a return pressure $P_2$, the RCD equipment being operably connected to the return line, and a regulator configured to adjust a fluid pressure supplied to the RCD to control the internal pressure $P_3$.

Clause 2: The system of clause 1, wherein the regulator includes a manual pressure regulator.

Clause 3: The system of any of clauses 1-2, further including a wellbore pressure gauge operably connected to the wellbore and configured to read the wellbore pressure $P_1$ at the wellbore below the RCD.

Clause 4: The system of clause 3, further including: a software logic configured to automatically control the wellbore pressure gauge and the regulator, wherein the regulator is further configured to control the internal pressure $P_3$ based on the wellbore pressure $P_1$ read by the wellbore pressure gauge.

Clause 5: The system of clause 4, further including: a return pressure gauge operably connected to the return line and configured to read the return pressure $P_2$ at the return line above the RCD, wherein the software logic is further configured to automatically control the return pressure gauge, and wherein the regulator is further configured to control the internal pressure $P_3$ based on the wellbore pressure $P_1$ read by the wellbore pressure gauge and the return pressure $P_2$ read by the return pressure gauge.

Clause 6: The system of clause 5, wherein the regulator is further configured to control the internal pressure $P_3$ according to:

$$P_3 \propto \frac{P_1}{P_2}.$$

Clause 7: The system of any of clauses 1-6, wherein the regulator is further configured to: receive information corresponding to the wellbore pressure $P_1$, and control the internal pressure $P_3$ based on the wellbore pressure $P_1$.

Clause 8: The system of clause 7, wherein the regulator is further configured to control the internal pressure $P_3$ according to: $P_3 \propto P_1$, where $P_3 < P_1$.

Clause 9: The system of any of clauses 1-8, further including a hydraulic logic circuit configured to: receive information corresponding to the wellbore pressure $P_1$, and automatically control the regulator to control the internal pressure $P_3$ based on the wellbore pressure $P_1$.

Clause 10: The system of clause 9, wherein the hydraulic logic circuit is further configured to control the regulator to control the internal pressure $P_3$ according to:

$$P_3 \propto \frac{P_1}{P_2}.$$

Clause 11: The system of any of clauses 1-10, further including: a reservoir configured to contain a fluid to be supplied to an input port of the RCD at the internal pressure $P_3$, and a pump operatively connected between the reservoir and the regulator, the pump being configured to supply the fluid from the reservoir to the regulator.

Clause 12: A method for a control system for a rotating control device (RCD) for rotary drilling in a wellbore, the method including: providing RCD equipment with an internal pressure $P_3$, providing a wellbore with a wellbore pressure $P_1$, the RCD equipment being operably connected to the wellbore, providing a return line leading toward a ground surface, the return line having a return pressure $P_2$, the RCD equipment being operably connected to the return line, and adjusting, by a regulator, a fluid pressure supplied to the RCD to control the internal pressure $P_3$.

Clause 13: The method of clause 12, further including reading the wellbore pressure $P_1$ at the wellbore below the RCD by a wellbore pressure gauge operably connected to the wellbore.

Clause 14: The method of clause 13, further including: automatically controlling the wellbore pressure gauge and the regulator using a software logic, and controlling the internal pressure $P_3$ by the regulator based on the wellbore pressure $P_1$ read by the wellbore pressure gauge.

Clause 15: The method of clause 14, further including: reading the return pressure $P_2$ at the return line above the RCD by a return pressure gauge operably connected to the return line, automatically controlling the return pressure gauge using the software logic, and controlling the internal pressure $P_3$ by the regulator based on the wellbore pressure $P_1$ read by the wellbore pressure gauge and the return pressure $P_2$ read by the return pressure gauge.

Clause 16: The method of clause 15, further including controlling the internal pressure $P_3$, using the regulator, according to:

$$P_3 \propto \frac{P_1}{P_2}.$$

Clause 17: The method of any of clauses 12-16, further including using the regulator to: receive information corresponding to the wellbore pressure $P_1$, and control the internal pressure $P_3$ based on the wellbore pressure $P_1$.

Clause 18: The method of clause 17, further including controlling the internal pressure $P_3$, using the regulator, according to: $P_3 \propto P_1$, where $P_3 < P_1$.

Clause 19: The method of any of clauses 12-18, further including using a hydraulic logic circuit to: receive information corresponding to the wellbore pressure $P_1$, and automatically control the regulator to control the internal pressure $P_3$ based on the wellbore pressure $P_1$.

Clause 20: The method of clause 19, further including controlling the regulator, using the hydraulic logic circuit, to control the internal pressure $P_3$ according to: P $$P_3 \propto \frac{P_1}{P_2}.$$

Clause 21: The method of any of clauses 12-20, further including: supplying a fluid, from a reservoir containing the fluid, to an input port of the RCD at the internal pressure $P_3$, and supplying the fluid from the reservoir to the regulator using a pump operatively connected between the reservoir and the regulator.

Systems and software, e.g., implemented on a non-transitory computer-readable medium, for performing the methods discussed herein are also within the scope of embodiments of the present disclosure.

Embodiments of the present disclosure may thus utilize a special purpose or general-purpose computing system including computer hardware, such as, for example, one or more processors and system memory. Embodiments within the scope of the present disclosure also include physical and other computer-readable media for carrying or storing computer-executable instructions and/or data structures, including applications, tables, data, libraries, or other modules used to execute particular functions or direct selection or execution of other modules. Such computer-readable media can be any available media that can be accessed by a general purpose or special purpose computer system. Computer-readable media that store computer-executable instructions (or software instructions) are physical storage media. Computer-readable media that carry computer-executable instructions are transmission media. Thus, by way of example, and not limitation, embodiments of the present disclosure can include at least two distinctly different kinds of computer-readable media, namely physical storage media or transmission media. Combinations of physical storage media and transmission media should also be included within the scope of computer-readable media.

Both physical storage media and transmission media may be used to temporarily store or carry, software instructions in the form of computer readable program code that allows performance of embodiments of the present disclosure. Physical storage media may further be used to persistently or permanently store such software instructions. Examples of physical storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored as or in software, hardware, firmware, or combinations thereof.

A "network" or "communications network" may generally be defined as one or more data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instructions or data structures and which can be accessed by a general purpose or special purpose computer.

Further, upon reaching various computer system components, program code in the form of computer-executable instructions or data structures can be transferred automatically or manually from transmission media to physical storage media (or vice versa). For example, computer-executable instructions or data structures received over a network or data link can be buffered in memory (e.g., RAM) within a network interface module (NIC), and then eventually transferred to computer system RAM and/or to less volatile physical storage media at a computer system. Thus, it should be understood that physical storage media can be included in computer system components that also (or even primarily) utilize transmission media.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

The invention claimed is:

1. A control system for a rotating control device (RCD) for rotary drilling in a wellbore, comprising:

RCD equipment having an internal pressure $P_3$, the RCD equipment being operably connected to a wellbore having a wellbore pressure $P_1$;

a wellbore pressure gauge operably connected to the wellbore and configured to read the wellbore pressure $P_1$ at the wellbore below the RCD equipment;

a return line leading toward a ground surface and having a return pressure $P_2$, the RCD equipment being operably connected to the return line;

a return pressure gauge operably connected to the return line and configured to read the return pressure $P_2$ at the return line above the RCD equipment;

a regulator configured to adjust a fluid pressure supplied to the RCD equipment to control the internal pressure $P_3$; and a software logic configured to automatically control the wellbore pressure gauge, the return pressure gauge, and the regulator, and wherein the regulator is further configured to control the internal pressure $P_3$ based on the wellbore pressure $P_1$ read by the wellbore pressure gauge and the return pressure $P_2$ read by the return pressure gauge.

2. The system of claim 1, wherein the regulator is further configured to control the internal pressure $P_3$ according to:

$$P_3 \propto \frac{P_1}{P_2}.$$

3. A method for a control system for a rotating control device (RCD) for rotary drilling in a wellbore, the method comprising:

providing RCD equipment with an internal pressure $P_3$;

providing a wellbore with a wellbore pressure $P_1$, the RCD equipment being operably connected to the wellbore;

providing a return line leading toward a ground surface, the return line having a return pressure $P_2$, the RCD equipment being operably connected to the return line;

reading the wellbore pressure $P_1$ at the wellbore below the RCD equipment by a wellbore pressure gauge operably connected to the wellbore;

reading the return pressure $P_2$ at the return line above the RCD equipment by a return pressure gauge operably connected to the return line;

adjusting, by a regulator, a fluid pressure supplied to the RCD equipment to control the internal pressure $P_3$;

automatically controlling the wellbore pressure gauge, the return pressure gauge, and the regulator using a software logic; and controlling the internal pressure $P_3$ by the regulator based on the wellbore pressure $P_1$ read by the wellbore pressure gauge and the return pressure $P_2$ read by the return pressure gauge.

4. The method of claim 3, further comprising controlling the internal pressure $P_3$, using the regulator, according to:

$$P_3 \propto \frac{P_1}{P_2}.$$

5. A method for a control system for a rotating control device (RCD) for rotary drilling in a wellbore, the method comprising:

providing RCD equipment with an internal pressure $P_3$;

providing a wellbore with a wellbore pressure $P_1$, the RCD equipment being operably connected to the wellbore;

providing a return line leading toward a ground surface, the return line having a return pressure $P_2$, the RCD equipment being operably connected to the return line; and adjusting, by a regulator, a fluid pressure supplied to the RCD equipment to control the internal pressure $P_3$;

using a hydraulic logic circuit to:

receive information corresponding to the wellbore pressure $P_1$; and automatically control the regulator to control the internal pressure $P_3$ based on the wellbore pressure $P_1$; and controlling the regulator, using the hydraulic logic circuit, to control the internal pressure $P_3$ according to:

$$P_3 \propto \frac{P_1}{P_2}.$$

* * * * *